United States Patent [19]

Tornya

[11] Patent Number: 4,586,697

[45] Date of Patent: May 6, 1986

[54] BALUSTRADE CONSTRUCTION

[76] Inventor: Isolde Tornya, 207 Edgecliff Road, Edgecliff, N.S.W., 2025, Australia

[21] Appl. No.: 671,818

[22] Filed: Nov. 16, 1984

[30] Foreign Application Priority Data

Sep. 15, 1981 [AU] Australia ..... PF0760

Related U.S. Application Data

[62] Division of Ser. No. 416,971, Sep. 13, 1982.

[51] Int. Cl.[4] ..... E04H 17/14

[52] U.S. Cl. ..... 256/65; 256/22; 256/59

[58] Field of Search ..... 256/22, 21, 59, 62, 256/65, 66; 52/690

[56] References Cited

U.S. PATENT DOCUMENTS

| | | | |
|---|---|---|---|
| 3,357,681 | 12/1967 | Souza, Jr. | 256/22 |
| 3,389,931 | 6/1968 | St. John | 256/59 |
| 3,424,834 | 12/1975 | Young | 256/22 |
| 3,463,456 | 8/1969 | Walker | 256/22 |
| 3,482,819 | 12/1969 | Leurant | 256/21 |
| 3,498,589 | 3/1970 | Murdock | 256/21 |
| 3,506,243 | 4/1970 | Seiler | 256/59 |
| 3,596,880 | 8/1971 | Greenberg | 256/59 |
| 3,918,686 | 11/1975 | Knott et al. | 256/22 |
| 3,955,799 | 5/1976 | Lauzier | 256/21 |
| 3,973,756 | 8/1976 | Lauzier | 256/21 |
| 4,014,520 | 3/1977 | Walters | 256/22 |
| 4,027,855 | 6/1977 | Lauzier | 256/59 |
| 4,073,477 | 2/1978 | Walters | 256/22 |
| 4,334,671 | 6/1982 | Deguise | 256/22 |
| 4,346,872 | 8/1982 | Tornya | 256/65 |

FOREIGN PATENT DOCUMENTS

| | | | |
|---|---|---|---|
| 2323837 | 4/1977 | France | 52/690 |

*Primary Examiner*—Donald G. Kelly
*Assistant Examiner*—Michael Safavi
*Attorney, Agent, or Firm*—Stevens, Davis, Miller & Mosher

[57] ABSTRACT

A balustrade construction formed from extruded components of such materials as aluminum and its alloys. Said construction having balusters disposed between pairs of spaced apart channel section members with the balusters comprised of a square-section and having a pair of slots cut into one side of the section for engagement with engaging elements of the channel section member.

4 Claims, 2 Drawing Figures

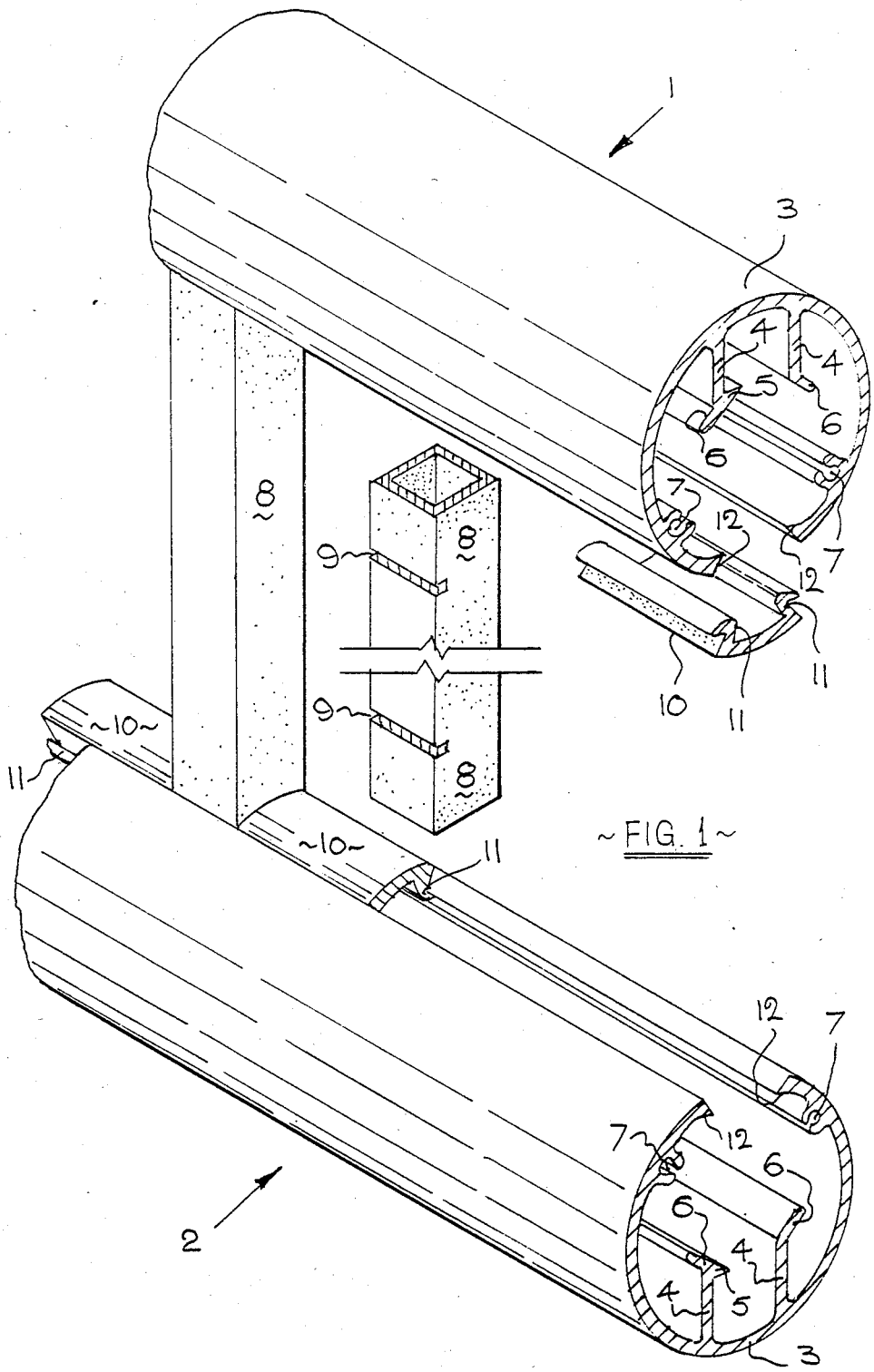
~ FIG. 1 ~

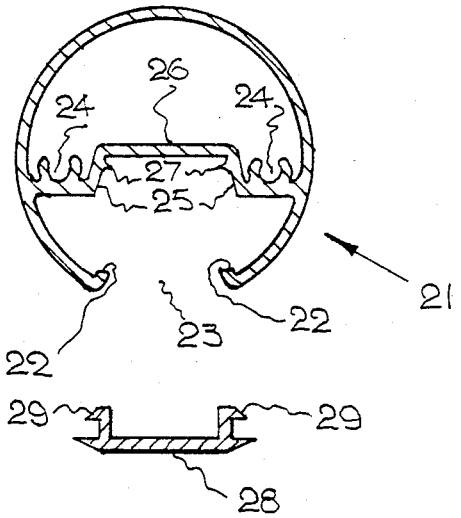
~ FIG. 2 ~

BALUSTRADE CONSTRUCTION

This application is a division of application Ser. No. 416,971, filed Sept. 13, 1982.

This invention relates to building construction from pre-fabricated units, and more particularly to the construction of balustrades and the like from extruded components of such materials as aluminum and its alloys.

It is known to clip together baluster modules to produce a sub-assembly to which is afterwards clipped a top rail.

Certain disadvantages of the above-mentioned system included the need to punch or drill holes in the modules and the need for a continuous top rail. The present invention dispenses with this need for the formation of holes, and the absence of a continuous top rail ensures that the modules before assembly may be packed into a container and transported with ease, or even supplied in the form of a 'do-it-yourself' kit for subsequent assembly by amateurs or other persons of limited skill.

The present invention is an improvement on certain other prior known systems including that of Australian Patent No. 477,021 and equivalent U.S. Pat. No. 3,924,834, wherein the clipping method is dependent upon the formation of a baluster of complex section necessary to admit it to an accepting channel, within which it is turned to wedge it between two inwardly-projecting lips of that channel. This arrangement requires the formation of cuts lying normal to the co-acting grooves.

Attempts have been made to improve the last-mentioned arrangement by sliding balusters lengthwise into the upwardly-facing mouth of a channel member forming the bottom rail of a balustrade and then sliding a lid or closure strip into a grooved section of the channel before pressing it up against the 'downstream' end of the last-assembled baluster, and so on. Such a system as this, however, has suffered from the disadvantage that a gap always existed beside each baluster, which gap tended to admit water and other foreign matter.

These and other disadvantages are largely overcome by the balustrading system described and claimed in the specification of Australian Patent Application No. 49,084/79, but it has now been found that even more effective and less expensive balustrading may be had by the provision of a balustrade unit comprising a pair of spaced-apart channel-section members, the mouths of which are adapted to be directed towards each other; a pair of longitudinally-extending, spaced-apart engaging elements provided on each channel-section member, at least one of the engaging elements being of hook-like cross-section; a plurality of balusters disposable between the channel-section members, each baluster having, on one side and adjacent each end thereof, a transverse slot, the two slots being parallel and the ends of the balusters being receivable between the engaging elements when the balusters are in position between the pair of channel-section members so that the hook-like engaging elements engage in the slots; and a plurality of spacers each one of which is extendable between adjacent balusters of the balustrade unit.

The pair of longitudinally-extending, spaced-apart engaging elements may be provided on and outstanding from the base portion of each channel-section member, or they may be provided on the free edges of the mouth of each channel-section member.

Each spacer is preferably provided with a pair of longitudinally-extending, spaced-apart engaging elements of hook-shaped cross-section adapted to engage with the engaging elements of a channel-section member.

In order that the reader may gain a better understanding of the present invention, hereinafter will be described certain preferred embodiments of it, by way of example only, and with reference to the accompanying drawings.

FIG. 1 is an isometric drawing showing a first embodiment of a balustrade unit according to the present invention; and FIG. 2 shows a transverse cross-section of a channel-section member and spacer of a second embodiment.

FIG. 1 illustrates a fragment of a balustrade unit which has a pair of spaced-apart channel-section members, namely an upper member generally referenced 1 and a lower member generally referenced 2, each said member preferably being an extruded member of aluminum or aluminum alloy. Although the drawing shows channel-section members of part-circular cross-section, it is nevertheless envisaged that these may equally well be of any other appropriate cross-section, for example, rectangular. As will be realized, channel-sections 1 and 2 are interchangeable and have mouths adapted to be directed towards each other as shown.

The base portion 3 of each channel-section member 1, 2 has provided upon it a pair of longitudinally-extending, spaced-apart engaging elements 4, the free edge of one engaging element of each pair being formed with a hook-like cross-section 5, and the edges of both engaging elements of each pair terminating in angled flanges 6. In addition, each channel-section member 1, 2 may be provided with longitudinally-extending screw-flutes 7. The purpose of hooked portions 5 and screw-flutes 7 will be explained hereinafter.

The balustrade unit includes a plurality of balusters 8, advantageously square-section extrusions of aluminum or aluminum alloy as illustrated. However, such balusters as 8 could also be formed from timber or other suitable rigid materials if desired, although highly preferred are square-sectioned balusters of, say, 15 to 20 mm external dimensions, ranging from 1.2 mm-wall hollow stock to solid square rod, circular-section stock being also contemplated. Balusters 8 may well be extrusions freely available from stock normally held by aluminum suppliers.

Each baluster 8 has in it transverse slots 9, one adjacent each end, and it will be appreciated that such may be economically fabricated from stock lengths of extrusions by what is known as a 'supersaw' possessing three saw blades mounted in parallel and with a predetermined gap between adjacent blades. Thus, at a single pass of the 'supersaw', three cuts are made, the middle cut being made right through the extrusion or rod and the two spaced side cuts producing top and bottom slots 9 respectively, so that while positioning the main (i.e. severing) cut with reference to the middle saw blade, the two slots are simultaneously formed, one being in that baluster which is next to be cut off and the other being the final slot in the baluster which has just been cut off, thereby achieving a major saving in cost. This is contrary to many presently-known systems wherein a hole is formed in a section which is destined to accept a baluster, and wherein the end of the baluster has a co-acting hole formed in it and, after passing the baluster through the first-mentioned holes, a holding crossscrew must be inserted. In the present invention, by contrast, all the forming operations are rapidly done at the time when the balusters are cut from the stock length, so that each one is identical simply because the spacing is easily made constant between the blades of the 'supersaw'.

The respective ends of each baluster 8 are received between the engaging elements 4 of the opposed pair of channel-section members 1, 2, being conveniently 'led in' by the outwardly-angled flanges 6, so that elements 4 are forced outwards a trifle before the hooked edge portions 5 'snap' into slots 9.

The balustrade unit has a plurality of spacers 10, each of which is configured to complete a part of a channel-section member, when in position, so as to endow it with a fully circular cross-section. These spacers 10, which may also be aluminum or aluminum alloy extrusions but are ideally of a suitable plastic material, extend between adjacent balusters as shown at the left-hand side of the drawing so as to effectively exclude water or other foreign matter from entering the channel-section member. Spacers 10 'snap' into place by virtue of their hooked free edges 11 which mate with the co-acting beads 12 on channel-sectioned members 1 and 2.

FIG. 2 shows transverse cross-sections of a channel-section member and associated spacer according to a second preferred embodiment which is even less expensive to produce. In this embodiment, a channel-section member generally referenced 21 is again advantageously an extruded member of aluminum or aluminum alloy but here the pair of longitudinally-extending, spaced-apart engaging elements 22 provided on member 21 take the form of the hook-shaped free edges of the mouth 23 of member 21. In addition, each channel-section member 21 may be provided with longitudinally-extending screw-flutes 24, the purpose of which will be described hereinafter.

The balusters are just as previously described with reference to FIG. 1 and in this embodiment their respective ends are received between the engaging elements 22 of the opposed pair of channel-section members 21, being conveniently 'led in' by the outwardly-angled walls 25, and bearing upon the lateral dividing wall 26 as the hooked edges 22 'snap' into slots 9 in the balusters. Angled walls 25 are each provided with a sharply-ridged 'shear-off' bead 27 which is severed or deformed by the passage of the baluster end, the better to ensure a rattle-free unit.

The baluster unit of this embodiment has a plurality of spacers 28 which, when in position, complete the perimeter configuration of the channel-section member; in the case illustrated, spacer 28 is flat-bottomed but it could as well easily be part-circular, as is spacer 10 of FIG. 1. Spacers 28 may again be of plastics, aluminum or aluminum alloy and 'snap' into place by virtue of their hooked engaging elements 29 which mate with the co-acting free edges 22 of the channel-section member 21.

Although not shown in the accompanying drawings, a suitable form of newel post may be installed at one or either end of a run of the balustrading, which may be held to the newel post or posts by such means as screws extending into screw-flutes 7 or 24.

The open mouths of the channel-section members will also accept a system of glazing strip members to permit the easy assembly of 'push-up-drop-down' glazing panels, as may readily be imagined.

While the above description is couched in terms of a balustrade unit, it is also envisaged that the channel-section members, balusters and spacers may be adapted to fencing units such as ornamental garden fences, in which case mesh panels or the like may well be incorporated. In either case, the labour component of the cost of producing and assembling the units is much reduced in comparison with that of prior known units.

From the foregoing, it will be readily appreciated that balustrade units made in accordance with the present invention enable considerable cost savings to be made from the use of ultra-light metal and plastic extruded members, which are undeniably more attractive to the eye than are the previously-known balustradings. Moreover, the use of hollow, uninterrupted sections of standard stock as balustrades ensures a great saving in fabrication costs and permits selection to be made from the wide range of commercially-available supplies.

What I claim is:

1. A balustrade unit comprising an interchangeable pair of spaced-apart channel-section members each of which is of part-circular cross-section, mouths of said spaced-apart channel-section members, when said balustrade unit is assembled, being directed towards each other, each said channel-section member of said interchangeable pair having a pair of longitudinally-extending, spaced-apart engaging elements constituted by inwardly-facing beads of hook-shaped cross-section formed along the free edges of the said mouths of said channel-section members; a lateral dividing wall extending longitudinally within each said channel-section member, said lateral dividing wall having a central footing portion joined to a pair of flanking portions by outwardly-angled walls so as to form a channel, a mouth of which is directed towards the said mouth of said channel-section member; a plurality of balusters disposable between said interchangeable pair of spaced-apart channel-section members; and a plurality of spacers each one of which is adapted to extend between an adjacent pair of balusters of the balustrade unit so as to close the gap between said adjacent balusters, the free longitudinal edges of each said spacer being formed so as to constitute engaging portions of hook-shaped cross-section adapted to engage with said pair of longitudinally-extending, inwardly-facing beads at the channel-members' mouths; each said baluster comprising a hollow, square-section member having, cut into one side thereof, a pair of transverse slots one adjacent each end of said baluster, said two slots being parallel, and the ends of the said balusters being adapted to abut a said central footing portion of a said lateral dividing wall when said balusters are in position between said interchangeable pair of channel-section members, the said hook-like, inwardly-facing engaging elements engaging with said transverse slots; each said outwardly-angled wall of a said channel being provided with, adjacent said central footing portion, a longitudinally-extending, sharply-ridged deformable bead, between an opposed pair of which a said baluster end is adapted to be firmly wedged.

2. The balustrade unit as claimed in claim 1, wherein each spacer is configured so that, when engaged with a channel-section member, it endoes the latter with a circular cross-section.

3. The balustrade unit as claimed in claim 1, wherein each said flanking portion of a said lateral dividing wall is formed with a longitudinally-extending, integral screw-flute on the side of said flanking portion remote from the mouth of said channel.

4. A balustrade unit comprising, in combination:

a pair of identical and interchangeable, spaced-apart channel-section members constituting an upper and a lower rail of said balustrade unit;

a plurality of balusters disposable between said pair of identical and interchangeable, spaced-apart channel-section members; and a plurality of spacing members, each one of which is adapted to engagingly extend between an adjacent pair of balusters of the balustrade unit so as to close the gap between said adjacent balusters;

each one of said pair of identical and interchangeable, spaced-apart channel-section members being part-circular in transverse cross-section, mouths of a said pair of identical and interchangeable, spaced-apart channel-section members being directed towards each other when said balustradeunit is assembled;

each one of said pair of identical and interchangeable, spaced-apart channel-section members being provided with a pair of longitudinally-extending, spaced-apart engaging elements constituted by inwardly-facing beads of hook-shaped cross-section formed along free edges of a said mouth of a said interchangeable, channel-section member;

each one of said pair of identical and interchangeable, spaced-apart channel-section members having, extending longitudinally therewithin, a lateral dividing wall which defines a closed interior cavity on a side of said lateral dividing wall which is remote from the mouth of a said interchangeable, channel-section member, said lateral dividing wall having a centrally-disposed footing portion joined to a pair of flanking portions by outwardly-angled walls so as to form a secondary channel, a mouth of which is directed towards the mouth of a said interchangeable, channel-section member, each said flanking portion of said lateral dividing wall being formed with a longitudinally-extending, integral screw-flute on a side of said flanking portion which lies within said closed interior cavity;

each one of said plurality of balusters comprising a hollow, square-section member having, cut into one side thereof, a pair of transverse slots one adjacent each end of said baluster, said pair of slots being parallel, and the ends of the said balusters being adapted to abut a said centrally-disposed footing portion of a said lateral dividing wall when said plurality of balusters is in position between said pair of identical and interchangeable, spaced-apart channel-section members, the said hook-like, inwardly-facing spaced-apart engaging elements thereof engaging with said transverse parallel slots; each said outwardly-angled wall of a said secondary channel being provided with, adjacent said centrally-disposed footing portion, an inwardly-facing, longitudinally-extending, sharply ridged deformable bead, between an opposed pair of which a said baluster end is adapted to be firmly wedged;

free longitudinal edges of each one of said plurality of spacing members being formed so as to constitute engaging portions of hook-shaped cross-section adapted to engage with said pair of longitudinally-extending, spaced-apart engaging elements provided on the said free edges of the mouth of a said interchangeable, channel-section member; each one of said plurality of spacing members being configured so that, when engaged with an interchangeable, channel-section member, it endoes the latter with a circular transverse cross-section.

* * * * *